US005951151A

United States Patent [19]

Doubeck et al.

[11] Patent Number: 5,951,151

[45] Date of Patent: Sep. 14, 1999

[54] LAMP ASSEMBLY FOR A RECESSED CEILING FIXTURE

[75] Inventors: David Edwin Doubeck, LaGrange; Ken Walter Czech, Itasca; Louise Mamerow Gardner, Arlington Hts.; David Jude Ziobro, Elk Grove Village; Rick Otto Meyer, Hoffman Estates, all of Ill.

[73] Assignee: Cooper Technologies Company, Houston, Tex.

[21] Appl. No.: 08/796,583

[22] Filed: Feb. 6, 1997

[51] Int. Cl.[6] ..... F21V 29/00; F21V 21/04

[52] U.S. Cl. ..... 362/365; 362/364; 362/294

[58] Field of Search ..... 362/294, 364, 362/365, 366, 147, 148, 373

[56] References Cited

U.S. PATENT DOCUMENTS

| | | | |
|---|---|---|---|
| 2,639,368 | 5/1953 | Pryne | 362/366 |
| 3,313,931 | 4/1967 | Klugman | 362/366 |
| 3,518,420 | 6/1970 | Kripp | 362/365 |
| 3,590,241 | 6/1971 | Docimo et al. | 362/366 |
| 3,609,346 | 9/1971 | Lund et al. | 362/364 |
| 4,510,559 | 4/1985 | Kristofek | 362/365 |
| 4,623,956 | 11/1986 | Conti | 362/148 |
| 4,754,377 | 6/1988 | Wenman | 362/294 |
| 5,130,914 | 7/1992 | Bengochea | 362/147 |
| 5,222,800 | 6/1993 | Chan et al. | 362/147 |
| 5,548,499 | 8/1996 | Zadeh | 362/365 |
| 5,562,343 | 10/1996 | Chan et al. | 362/147 |
| 5,758,959 | 6/1998 | Sieczkowski | 362/148 |

*Primary Examiner*—Laura Tso
*Attorney, Agent, or Firm*—Burns, Doane, Swecker & Mathis LLP

[57] ABSTRACT

A lamp assembly for a recessed ceiling fixture includes a support, a lens retainer removably mounted to the support and carrying a lens, a heat shield removably mounted on the lens retainer above the lens, an electric socket supported by an upper end of the heat shield, and a lamp disposed within and supported by the heat shield and electrically coupled to the socket. The lamp includes a reflecting surface that reflects visible light forwardly and transmits heat rearwardly toward a dome shaped reflector surface of the heat shield which reflects that heat forwardly. The heat shield, lamp, and socket can be removed as a unit from the lens retainer in order to be able to replace the lamp while leaving the lens in place. When re-mounting the unit, the lamp engages centering surfaces carried by the lens retainer to center the lamp relative to the lens.

12 Claims, 6 Drawing Sheets

LAMP ASSEMBLY FOR A RECESSED CEILING FIXTURE

BACKGROUND OF THE INVENTION

The present invention relates to recessed light fixtures and in particular to such a fixture employing a dichroic lamp (e.g., MR11, MR16, and cool beam par lamps) which reflects light forwardly while permitting heat to pass rearwardly therethrough.

A predominate light source within the lighting industry is the low voltage MR16 dichroic lamp. That compact light source provides crisp white light with pin point control in a two-inch lamp diameter. This lamp is available as a cool beam lamp, the glass structure being coated with a dichroic reflective coating. That coating allows about 60% of the radiant heat to transmit rearwardly through the reflector surface, while reflecting nearly 99% of the visible light forwardly. However, the additional heat emitted towards the rear of the lamp results in various manufacturing concerns, such as:

1) Increased skin temperatures of the recessed housing. Underwriters Laboratories (UL) sets limits on skin temperatures disposed in direct contact with insulation.

2) The emission of visible light rearwardly along with the heat from the dichroic reflector. That allows end users to see into the recessed housing and is aesthetically unacceptable.

3) Increased heat in the recessed housing. This can shorten the life of components such as magnetic or electronic transformers, or discolor painted surfaces.

4) Increased heat around the socket. That can increase the lamp pin/socket contact temperatures above the lamp manufacturer's design levels, causing short lamp life and necessitating the use of more expensive wire and socket components.

It is known from Kim U.S. Pat. No. 3,769,503 and David U.S. Pat. No. 5,130,913 to provide a heat-reflective surface behind a dichroic lamp to reflect the heat forwardly. In particular, each of those patents discloses the provision of a metallic cup-shaped heat reflector spaced behind a dichroic lamp which acts on heat radiation that has passed rearwardly through the reflector surface of the lamp to reflect that radiation forwardly.

In the Kim fixture, the heat reflector is pivotally supported on an axle to rotate about the dichroic lamp. In the David fixture, the heat reflector is supported by the lamp or by the socket in which the lamp is coupled, but there is no disclosure of how the lamp and socket themselves would be supported.

When employing a heat reflector in combination with a dichroic lamp, there are serious concerns involving the mounting of the components which are not addressed by either of the Kim and David patents. That is, it is necessary to achieve a proper orientation of the lamp to ensure that the light is directed as intended, and also to prevent the glass lamp from contacting the hot reflector. This must be achieved while maintaining a proper alignment between the metallic heat reflector and the lamp to ensure that the heat is reflected by the metallic element in an optimum direction with respect to the lamp. This means that a reliable amount of positional control must be exerted upon both the lamp and the heat reflector. However, such control should not result in excessive pressure being applied to the lamp, which could cause damage to the lamp.

Furthermore, MR16 lamps are supposed to have a UL listed lens installed in the front thereof to protect the user in the rare case the hologen lamp capsule explodes (non-passive failure). In a typical MR16 installation, a gimbal ring holds the lens, and the lamp sits in the gimbal ring such that the front rim of the lamp abuts the lens. Such an arrangement not only obstructs the light radiation, but also obstructs the escape of heat from within the lamp, whereby an undesirable heat build-up can occur.

Also, in the typical installation, it is possible for the lamp to be installed without the lens, thereby violating UL requirements.

SUMMARY OF THE INVENTION

The present invention relates to a lamp assembly comprising a support, a heat shield, an electrical socket, and a lamp. The support includes an aperture extending therethrough. The heat shield includes a dome-shaped portion, and a mounting structure for removably mounting the heat shield to the support. The dome-shaped portion includes an interior heat reflecting surface facing in a forward direction. The electrical socket is disposed on a rear wall of the heat shield and is supported thereby. A lamp is disposed within the dome-shaped portion and is electrically connected to the socket so as to be supported by the heat shield. The lamp includes a forwardly facing reflecting surface capable of reflecting visible light forwardly while allowing radiant heat to pass rearwardly therethrough toward the heat reflecting surface of the dome-shaped portion.

The support preferably includes a lamp-centering structure. The lamp includes a front portion engaging the lamp-centering structure for centering the lamp relative to the aperture.

A lens is preferably mounted to the support in front of the lamp. The heat shield, the socket, and the lamp are removable and insertable as a unit while the lens remains mounted to the support.

The heat shield is preferably removably mounted on the lens retainer and is removable therefrom in a rearward direction. The lens retainer is removable from a table portion of the support in a forward direction.

A gap is preferably disposed between a front rim of the lamp and the lens to permit the escape of heat from within the lamp.

Another aspect of the present invention relates to a recessed lighting fixture for a ceiling, the fixture comprising a lamp, a reflector disposed below the lamp, and a trim ring having an annular shoulder upon which a radially outwardly projecting flange of the reflector rests. The trim ring includes an annular, radially inwardly facing surface extending downwardly from a radially inward edge of the shoulder. The improvement involves the reflector including an annular bead projecting downwardly from a radially inner end of the flange to cover the surface. Preferably, the inwardly facing surface is beveled such that an upper end thereof is situated radially outwardly with respect to a lower end thereof.

BRIEF DESCRIPTION OF THE DRAWINGS

The objects and advantages of the invention will become apparent from the following detailed description of a preferred embodiment thereof in connection with the accompanying drawing in which like numerals designate like elements and in which.

DETAILED DESCRIPTION OF A PREFERRED EMBODIMENT OF THE INVENTION

Figure 4:
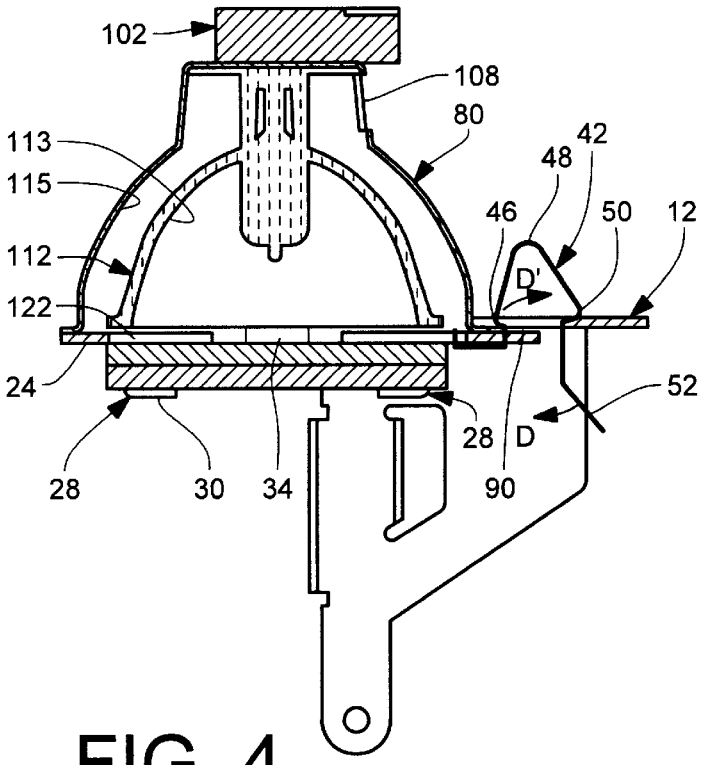
FIG. 4 is a sectional view taken along the line 4—4 in FIG. 2.
Figure 5:
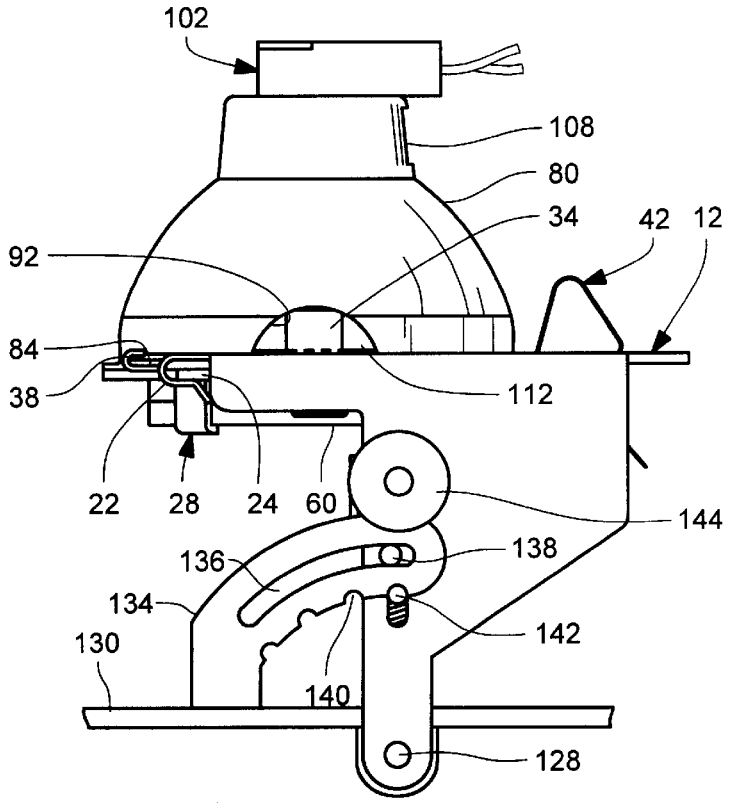
FIG. 5 is a side elevational view of the lamp assembly depicted in FIG. 2 in a state wherein it is mounted to a rotary ring.
Figure 6:
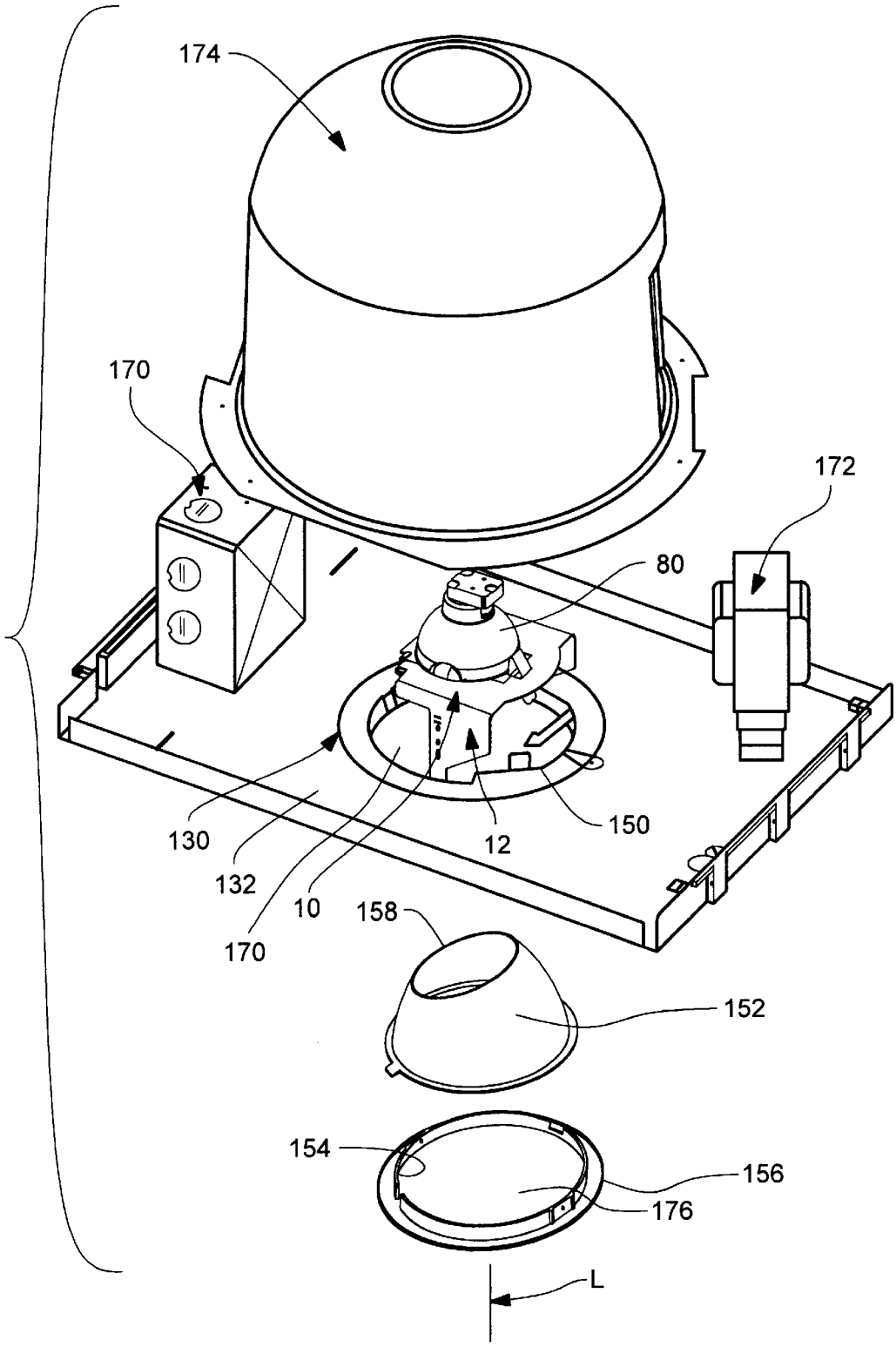
FIG. 6 is a top perspective exploded view of a recessed ceiling fixture utilizing the lamp assembly depicted in FIG. 2.
Figure 7:
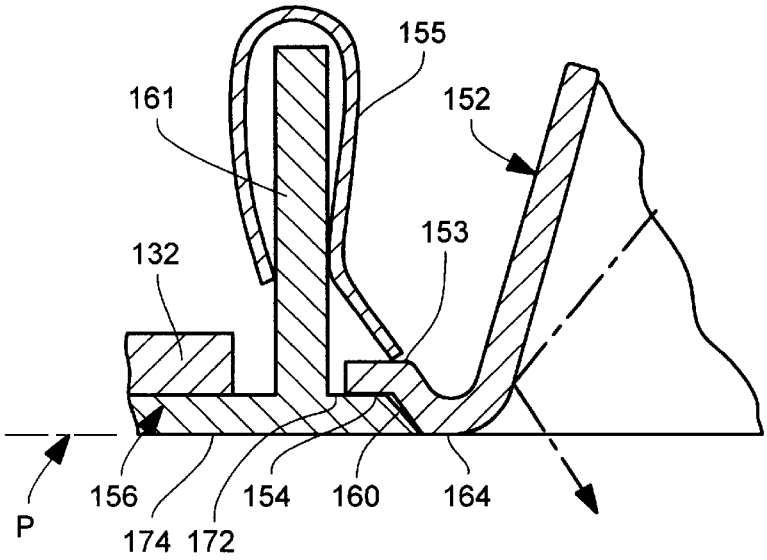
FIG. 7 is a fragmentary vertical sectional view through one side of a trim plate of the fixture depicted in FIG. 6, and a fragmentary vertical sectional view through a reflector supported on the trim plate.
Figure 8:
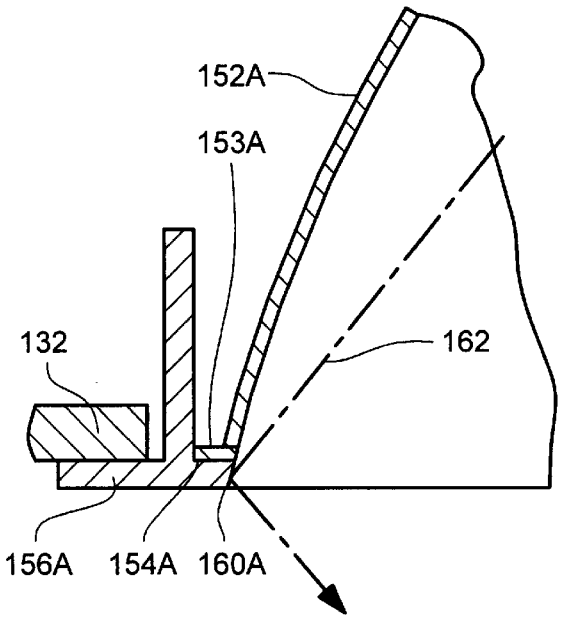
FIG. 8 (PRIOR ART)
FIG. 8 is a view similar to FIG. 7 of a prior art arrangement.

A light assembly 10 is depicted in FIGS. 1–5, and the use of that lamp assembly within a light fixture is depicted in FIGS. 6–8. The light assembly includes a support in the form of an adjustment arm 12 which includes a table 14 from which a pair of mounting arms 16 project downwardly. The table 14 includes a generally circular aperture 18 which is shown as intersecting one edge 20 of the table (although it need not intersect the table). A pair of tabs 22, integral with the table 14, are bent downwardly and reversely in U-shaped fashion to form respective slots for a purpose to be explained. The tabs 22 are disposed on opposite sides of the aperture 18, but only one tab 22 is visible in the drawing.

Removably mounted on the adjustment arm 12 is a lens retainer in the form of a plate 24 which includes a generally circular aperture 26. Projecting downwardly from a wall of the aperture 26 are lens-holding tabs 28 (e.g., four in number), the lower portions of which are bent at right angles to form lens-seating seats 30 (see FIG. 4).

Projecting upwardly from the wall of the aperture 26 are two diametrically opposed lugs 32. Those lugs serve as supports for respective lens retainer springs 34 which are riveted to the lens retainer plate 24, as will be explained. An edge 36 of the lens retainer plate 24 includes a pair of tabs 38 that are bent upwardly and reversely to form a pair of slots. The tabs 38 are disposed on opposite sides of the aperture 26, but only one tab 38 is visible in the drawing.

Attached to an edge 40 of the lens retainer plate 24 disposed opposite the edge 36 is a relamping spring 42 which holds the lens retainer plate to the adjustment arm. The relamping spring 42 includes a mounting portion 44 which extends beneath the lens retainer plate 24 and is affixed thereto (e.g., by a rivet), a first shoulder portion 46 overlying the lens retainer plate 24 by a certain distance thereabove, a bend 48, a second shoulder portion 50 projecting opposite to the first shoulder portion, and a manual actuating portion 52. The second shoulder 50 is arranged to enter a notch 54 projecting from a wall of the aperture 18 in order to overlie the adjustment arm 12, and thereby secure the lens retaining plate 24 to the adjustment arm 12 as shown in FIG. 4. That is, notches 49 formed in the edge 36 of the lens retainer plate can be inserted into the slots formed by the tabs 22 of the adjustment arm, and then the lens retainer plate 24 can be pivoted upwardly about an axis defined by those slots, with the actuating portion 52 of the relamping spring 40 elastically bent in direction D (FIG. 4), enabling the second shoulder 50 of the relamping spring to pass upwardly through the notch 54 of the adjustment arm 12. Upon releasing the actuating portion 52, the second shoulder portion 50 snaps into position overlying the table 14, thereby securing the lens retainer plate 24 to the adjustment arm 12, with the apertures 18, 26 being in mutual alignment. Removal of the lens retainer plate 24 from the adjustment arm 12 is performed by reversing the above steps.

Figure 1:
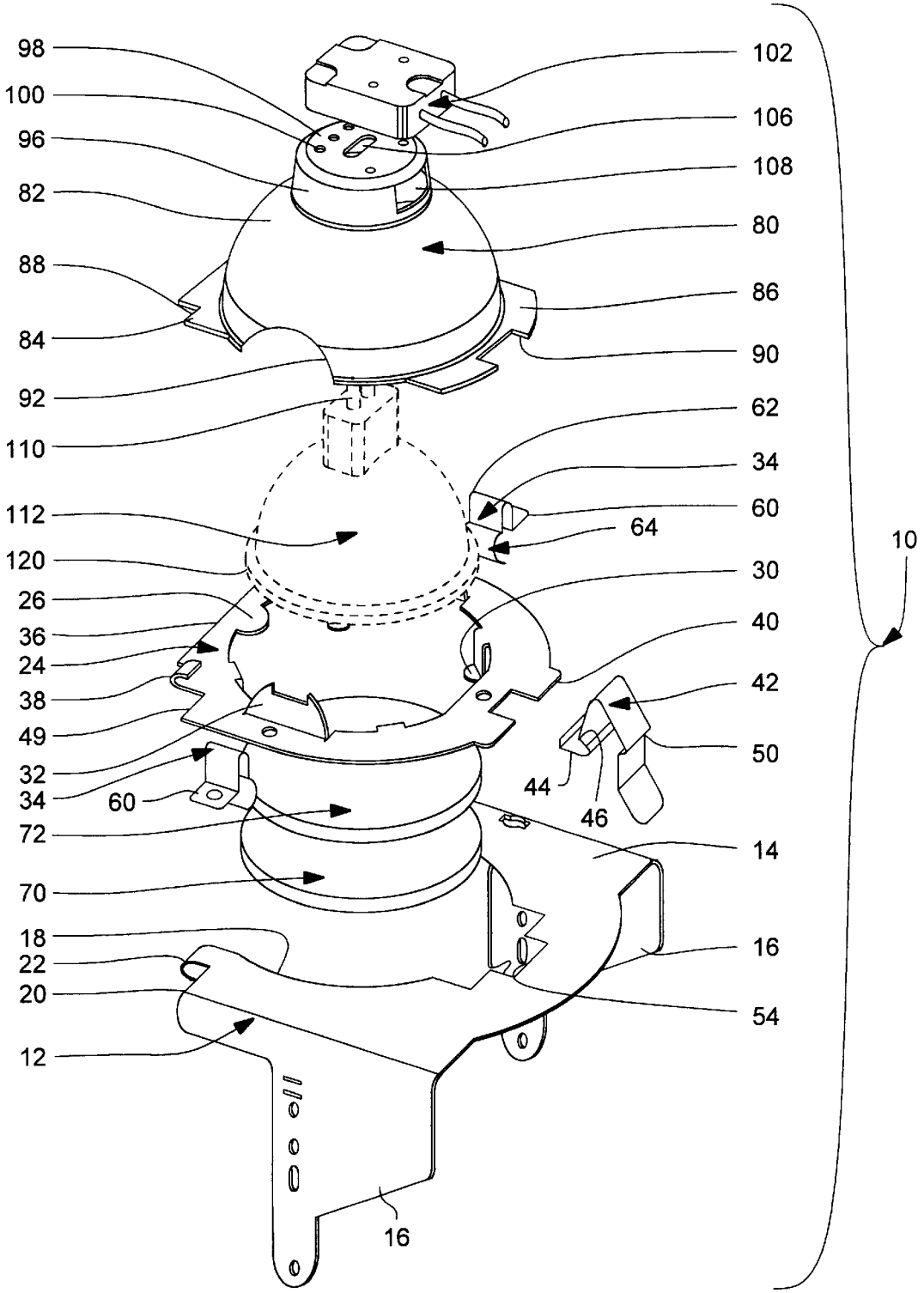
FIG. 1 is an exploded perspective view of a lamp assembly according to the present invention.
Figure 2:
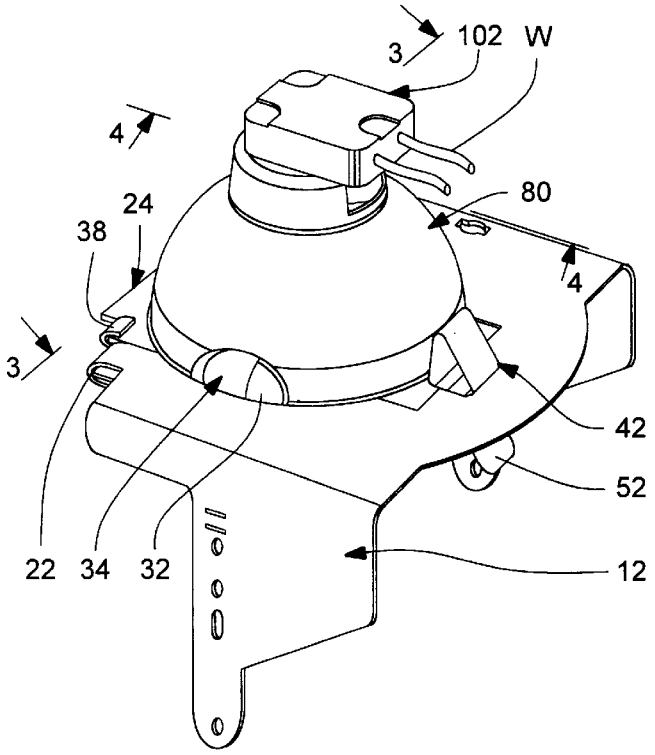
FIG. 2 is a top perspective view of the lamp assembly depicted in FIG. 1.
Figure 3:
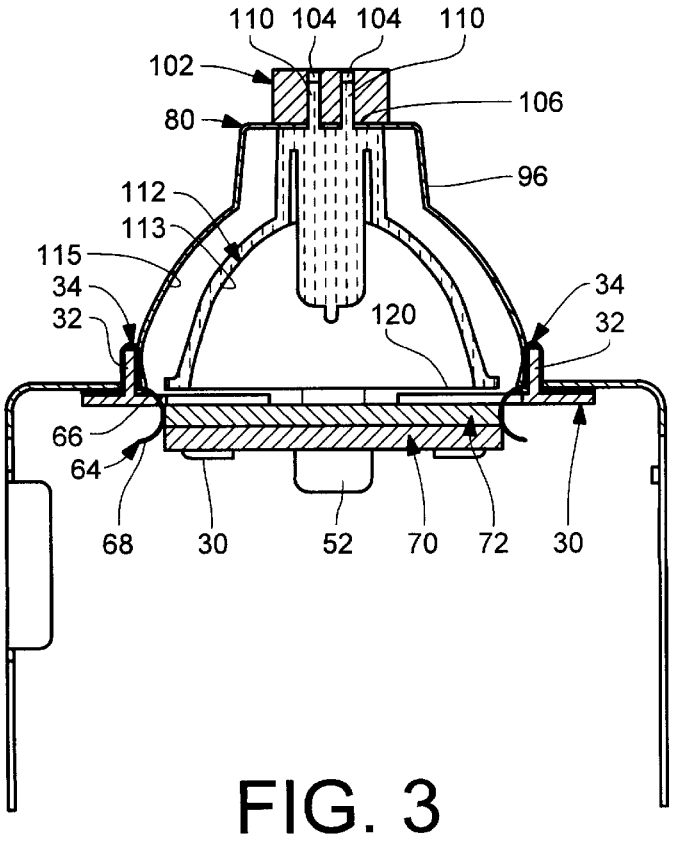
FIG. 3 is a sectional view taken along the line 3—3 in FIG. 2.

Each of the above-mentioned lens retainer springs 34 includes a mounting portion 60 affixed to the lens retainer plate 24 (e.g., by a rivet), a bend 62, and a downwardly extending portion 64 that is curved such that a convex side thereof projects toward the aperture 26. Each of the upper and lower sections 66, 68 of the downwardly extending portion 64 forms a retaining shoulder. That is, the lower section 68 bears against the outer periphery of a lens 70 seated on the seats 30 of the lens holding tabs 28, as shown in FIG. 3, in order to prevent wobbling thereof. An additional (optional) lens 72 may be seated atop the lens 70, if desired.

Mounted on the lens retainer plate 24 is a heat shield 80 which includes a dome-shaped portion 82 and a pair of mounting flanges 84, 86 bent from a bottom or front rim of the dome-shaped portion 82. The mounting flange 84 includes a pair of notches 88 adapted to be inserted into respective slots formed by the tabs 38 of the lens retainer plate 24. Then, the lens retainer plate 24 can be swung downwardly or forwardly about an axis defined by those slots until the portion of relamping spring 42 which forms the first shoulder 46 enters a notch 90 formed in the flange 86 of the heat shield 80 and is depressed in direction D' until the flange 86 becomes disposed below the first flange 86. At that point the shoulder 46 springs back in a direction opposite D' to overlie the flange 86, thereby attaching the heat shield 80 to the lens retainer plate 24. The heat shield flange 86 becomes trapped between the lens retainer plate 24 and the table 14. Removal of the heat shield is performed by reversing those steps.

The dome-shaped portion 82 of the heat shield 80 includes a pair of diametrically opposed cut-outs 92 for enabling the lens retainer springs 34 to pass therethrough as shown in FIG. 3. Also, the cut-outs 92 enable a user's fingers to grip and remove a lamp as will become apparent.

Projecting upwardly from the dome-shaped portion 82 is an upper cylindrical portion 96 having a stop or rear wall 98. Affixed to the top wall 98, e.g., by rivets extending through holes 100 formed in the top wall 98, is a conventional socket 102. The socket 102 includes a pair of electric terminal holes 104 (see FIG. 3) which are aligned with an elongated slot 106 formed in the top wall 98.

Formed in the cylindrical portion 96 is an opening 108 which provides for a circulation of air near the terminal pins 110 of a lamp 112 for cooling the pins, and permitting a user to visually align the pins 110 with the terminal holes 104 during a relamping operation.

The lamp 112 is a low voltage MR16 lamp which, as described earlier, possesses a forwardly facing surface 113 coated with a dichroic reflective coating which allows about 60% of the radiant heat to transmit rearwardly therethrough, while reflecting nearly 99% of the visible light forwardly.

A downwardly or forwardly facing surface 115 of the dome-shaped portion 82 constitutes a heat reflecting surface. The heat shield 80 can be formed of metal, such as unpolished aluminum which is deep drawn to the final shape and then anodized, top coated, or painted. Alternatively, the heat shield could be formed of ceramic or a high temperature resistant plastic. The reflectance characteristic of the surface can run the range from a specular finish to a lambertion (diffuse) finish.

Before the heat shield 80 is mounted on the lens retainer plate 24, the lens(es) 70, 72 is seated upon the lens-holding tabs 28, and the lamp 112 is plugged into the terminal holes 104. Then, the heat shield/lamp unit 80, 112 is mounted to a support unit defined by the table 14 and lens retainer plate 24 by inserting the notches 88 into the slots of the tabs 38, and swinging the unit downwardly about an axis defined by those slots. Eventually, the notch 90 in the flange 86 engages and deflects the relamping spring 42 in the direction D' as the notch 90 travels downwardly past the spring 42. Thereafter, the shoulder 46 of the spring 42 snaps back in a direction opposite D' to overlie the flange 86.

As this occurs, the bottom or front rim 120 of the lamp 112 engages the upper lamp-centering sections 66 of the lens retainer springs 34 to automatically become centered relative to the aperture 26, and thus relative to the lens(es) 70, 72 (see FIG. 3). Centering of the lamp 112 in that manner is possible, because the pin mounting 110, 104 of the lamp permits a slight amount of free movement of the lamp relative to the heat shield.

Removal of the unit 80, 112 for relamping purposes is performed by reversing the above steps. It will be appreciated that such removal can be performed without having to remove the lens(es). This not only simplifies the relamping procedure, but eliminates any risk of the lens(es) being broken, or that the user will forget to reinstall the lens(es).

With the unit 80, 112 in place, the lower rims of both the heat shield and lamp are spaced above the lens(es), and a gap 122 exists between those lower rims, the top surface of the lens(es), and the lens retainer plate 24 and heat shield 80 to enable heat from within the lamp 112 to escape.

The above-described lamp assembly 10 is mounted in a surface of a room, such as a ceiling. As depicted in FIGS. 5 and 6, the legs 16 of the adjustment arm 12 of the lamp assembly 10 are attached by pivot pin 128 to a rotary ring 130 that is mounted for rotation about a vertical axis in a circular hole 170 formed in a plaster frame 132, which hole forms a longitudinal axis L. The rotary ring 130 carries a bracket 134 having a slot 136 formed therein. A dimple 138 formed in one leg 16 engages the walls of the slot to guide the adjustment arm 12 during its rotation. Notches 140 formed in one edge of the bracket 134 are adapted to receive a yieldable locating element 142 of any suitable type for performing a ratcheting action to define various positions of angular adjustment for the adjustment arm 12 (e.g., at five degree increments). Indicia could be provided on the bracket indicating the angles of inclination of the lamp associated with each notch. A clamping knob 144 is screw-threaded to the adjustment arm, whereby the bracket 134 can be clamped between the knob 144 and the adjustment arm to secure the adjustment arm in a selected position of adjustment. By angularly adjusting the adjustment arm 12, the direction of emission of light from the lamp 112 can be varied.

The rotary ring 130 carries a locking finger 150 which is pivotable about a vertical axis between ring-unlocking and locking positions. In the position depicted in FIG. 6, the locking finger 150 is in the locking position wherein a portion of the locking finger abuts a shoulder (not shown) of the plaster frame to prevent rotation of the rotary frame. To unlock the rotary ring 130, the locking finger is rotated such that the locking finger projects into the center aperture of the rotary ring. Accordingly, the locking finger 150 must be in a locking position in order to insert the trim.

Figure 9:
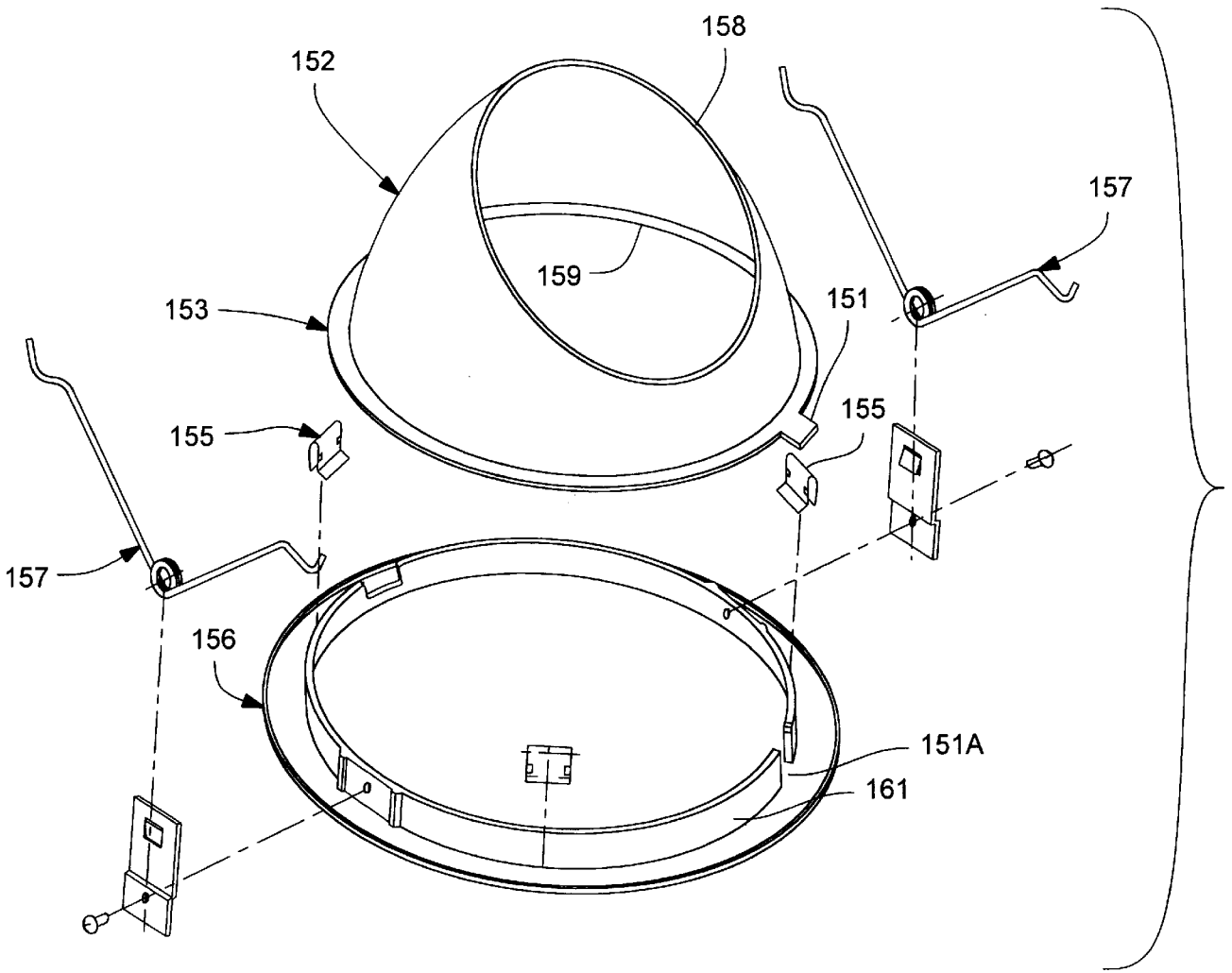
FIG. 9 is an exploded perspective view of a reflector and trim ring according to the present invention.

Fixedly attached to the rotary ring is a reflector 152 which has a radially outwardly extending annular flange 153 resting slidably on a radially extending annular shoulder 154 of a trim ring 156, i.e., on a first surface 172 of that shoulder 154 which faces toward the hole 170. The shoulder includes a second surface 174 facing away from the hole 170 and lying in a plane P. The trim ring 156 includes a hole 176 extending along the axis L. The trim ring 156 is attached to the plaster frame 132 by conventional torsion springs 157 (see FIG. 9). The reflector 152 includes an inclined aperture 158 at its upper end which accommodates the angular positioning of the adjustment arm 12 about an axis defined by the pivot pins 128. The reflector 152 includes another aperture 159 at its lower end, the apertures 158 and 159 spaced apart along the axis L. A tab 151 (FIG. 9) formed on the flange 153 projects radially into a slot 151A formed in a vertical cylindrical wall 161 of the trim ring 156, in order to properly angularly orient the reflector 152 relative to the trim ring 156. Spring clips 155 retain the reflector in place on the trim ring. The spring clips are removable to permit the reflector to be removed, e.g., to be painted.

A prior art trim ring 156A and reflector 152A depicted in FIG. 8 also includes a shoulder 154A on the trim ring 156A, and a radial flange 153A of the reflector resting on the shoulder. The trim ring 156A also includes a radially inwardly facing annular third surface 160A extending downwardly from a radially inner end of the first surface 172, which surface 160A is exposed to light rays within the reflector. Thus, a light ray 162 from the lamp can reflect off that surface 160A (which does not possess a reflective finish) to create an aesthetically unpleasant appearance to a viewer looking up from below.

The present invention avoids that shortcoming, because the reflector 152 includes an annular bead or ridge 164 extending downwardly toward the plane P from a radially inner end of the flange 153. That bead covers the radially inwardly facing surface 160, thereby preventing that surface 160 from reflecting light rays. Rather, the light is reflected by the reflective surface of the reflector as shown in FIG. 7.

Furthermore, the surface 160 is beveled such that its upper end is disposed radially outwardly with respect to its lower end. Because of that bevel, there is no aesthetically displeasing radial gap extending between the surface 160 and the bead 164 which could be visible from below.

Further components of the light fixture depicted in FIG. 6 include a standard J-box 170 and transformer 172 mounted on the plaster frame 132, and an inner housing or can 174 fastened to the plaster frame in overlying relationship to the light assembly 10. An outer housing (not shown) would encompass the inner housing 174.

To install a light assembly according to the present invention, the lamp 112 is inserted into the socket 102 with the heat shield 80 removed from the lens retainer plate 24. The heat shield 80 is mounted onto the lens retainer plate 24 by inserting the notches 88 of the heat shield into the slots formed by the tabs 38 of the lens retainer and then swinging the heat shield downwardly until the notch 90 thereof snaps into place beneath the shoulder 46 of the relamping spring 42. As this occurs, the lower rim of the lamp will engage the upper sections 66 of the lens retainer springs 34 and become automatically centered with respect to the apertures 26, 18 and the lens(es) 70, 72. Then, with the lens retainer plate 24 attached to the table 14, and with one or more of the lenses 70, 72 seated on the lens retainer 24.

Then, the adjustable arm 12 is swung about the pivot pins 128 (FIG. 5) until the lamp is at the desired angular relationship, whereupon the clamp knob 144 is tightened. The rotary ring 130 is then rotated to project the light in the desired direction.

During use, the lamp 112 reflects 99% of the visible light and 40% of the radiant heat forwardly, and transmits 60% of the radiant heat and 1% of the visible light rearwardly. The rearwardly transmitted heat and light energy engages the reflective surface of the heat shield 80 and is reflected forwardly. This energy is reflected out from behind the lamp in two ways: 1) re-transmitting through the dichroic reflector or 2) reflecting around the perimeter of the lamp. Passing light around the exterior of the lamp is preferred so that the components of the lamp, such as the pinch seal, do not receive any increase in thermal load. A variety of general contours of the reflective surface of the heat shield can be designed to achieve these results. For instance that reflective surface can have a parabolic contour, however any conic section (linear, circular, parabolic, elliptical, hyperbolic) or derived contour (involute, macro-focal conic) may be used depending on the physical constraints of the recessed housing.

By reflecting the heat forwardly, the components disposed behind the lamp are not overheated. By reflecting the visible light forwardly, the area behind the lamp does not become illuminated so as to create an unpleasant appearance to a viewer.

To relamp, a user's hand reaches up through the aperture of the rotary ring and pushes against the lower actuating portion 52 of the relamping spring 42 in direction D in FIG. 4 to disengage the shoulder 50 from the table 14 to enable the edge 40 of the lens retainer plate 24 to be slightly swung down. Thus, the heat shield 80, together with the lamp 112 and socket 102 and retain plate 24, can be maneuvered downwardly through the aperture in the rotary plate 130 by a distance dependent upon the amount of slack contained in the wires W of the socket 102, but at least sufficiently far to enable the user to grasp and remove the lens retainer plate 24 by depressing the spring 42 to disengage the shoulder 46 from the flane 86 of the heat shield, as well as removing the lamp 112 from the heat shield. Such removal is facilitated by the finger cut-outs 92 formed in the heat shield. A new lamp is installed, with the user being able to guide the pins 110 into the terminal holes 104 of the socket by looking through the opening 108 formed in the heat shield 80. Then, the above steps are reversed to reattach the heat shield and lens retainer plate. Thus, the lamp can be replaced without having a loose lens; nor can the lamp be installed without the lens retaiing plate.

It will be appreciated that the present invention provides a convenient way of assembling a light fixture. In particular, the heat shield 80 and lamp 112 can be removed without disturbing the lenses. Hence, there is less risk of damaging the lenses or forgetting reinstall the lenses, or for the user to become cut by a rough edge of a lens.

The heat shield is automatically positioned in a specific location relative to the lens retainer plate 24, by the engagement of the notches 88 in the tabs 38, and by the engagement of the notch 90 with the relamping spring 42. Also, the lamp 112 is automatically centered by the lens retainer springs 34 when the heat shield is installed. Thus, the reflective surfaces of the heat shield and lamp are properly aligned with respect to the apertures 26, 18 and lenses 70, 72 and with respect to one another. Further, there is no risk that the side of a hot heat shield can contact the lamp.

During use of the lamp 112, the space between the lower rim of the lamp and the lenses permits the escape of heat from within the lamp and from between the heat shield 80 and the lamp 112.

Since the lamp is supported by the heat shield, the heat shield absorbs the mounting forces, to minimize any risk of damage to the lamp.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A lamp assembly comprising:

a support including an aperture extending therethrough;

a heat shield removably mounted to the support and including a dome-shaped portion, the dome-shaped portion including an interior heat-reflecting surface facing in a downward direction toward the aperture;

an electrical socket disposed on an upper wall of the heat shield facing away from the aperture and supported thereby; and a lamp disposed within the dome-shaped portion and electrically connected to the socket and supported directly by the heat shield, the lamp including a downwardly facing reflecting surface defining means for reflecting visible light downwardly while allowing radiant heat to pass upwardly therethrough toward the heat-reflecting surface of the dome-shaped portion.

2. A lamp assembly comprising:

a support table including an aperture extending therethrough;

a lens retainer removably mounted on the support table;

a lens carried by the lens retainer in alignment with the aperture;

a heat shield removably supported by the lens retainer and including a dome-shaped portion having an interior heat-reflecting surface facing in a downward direction toward the lens retainer;

an electrical socket supported by the heat shield; and a lamp disposed within the dome-shaped portion and electrically connected to the socket so as to be supported by the heat shield; the lamp disposed between the heat shield and the aperture and including a downwardly facing reflecting means for reflecting visible light downwardly and while allowing radiant heat to pass upwardly therethrough toward the heat-reflecting surface of the dome-shaped portion;

the heat shield, the socket, and the lamp being interconnected to form a first unit which is removable from the lens retainer relative to the lens, and the lens retainer and lens being interconnected to form a second unit which is removable from the support table; and a relamping spring mounted on the lens retainer and including a first portion yieldably securing the lens retainer to the support table, and a second portion yieldably securing the heat shield to the lens retainer.

3. A lamp assembly comprising:

a support;

a lens retainer removably mounted to the support and including an aperture extending therethrough;

a lens removably mounted on the lens retainer;

a heat shield including a dome-shaped portion having an interior heat-reflecting surface, the heat shield being removably mounted on the lens retainer such that the heat-reflecting surface faces downwardly toward the aperture;

an electrical socket directly mounted on an upper surface of the heat shield facing away from the aperture and supported thereby; and a lamp disposed within the dome-shaped portion and electrically connected to the socket so as to be supported directly by the heat shield, the lamp disposed between the heat shield and the aperture and including a downwardly facing reflecting means for reflecting visible light downwardly and allowing radiant heat to pass upwardly therethrough toward the heat-reflecting surface of the dome-shaped portion;

the heat shield, the socket, and the lamp being interconnected to form a unit which is releasably connected to the lens retainer and removable from the lens retainer independently of the lens.

4. The lamp assembly according to claim 3 further including lens retainer springs mounted to the lens retainer; each lens retainer spring including a first portion engaging a front rim of the lamp for centering the lamp relative to the aperture and lens, and a second portion engaging an outer periphery of the lens to prevent wobbling thereof.

5. The lamp assembly according to claim 3, wherein the lens retainer includes lamp-centering elements arranged around a circumference of the aperture, the lamp including a front portion engaging the lamp-centering elements for centering the lamp relative to the aperture.

6. The lamp assembly according to claim 3, wherein there is a gap disposed between a lower rim of the lamp and the lens to define means for permitting the escape of heat from within the lamp.

7. The lamp assembly according to claim 3, wherein the support comprises a table to which the lens retainer is removably mounted, the lens retainer being removable from the table in a downward direction; the heat shield being removable from the lens retainer in an upward direction.

8. The lamp assembly according to claim 7, wherein the table includes a pair of first slots for receiving an edge of the lens retainer and permitting the lens retainer to pivot about a first axis defined by the first slots; the lens retainer including a pair of second slots for receiving a front edge of the heat shield and permitting the heat shield to pivot about a second axis defined by the second slots.

9. The lamp assembly according to claim 8 further including a relamping spring attached to the lens retainer and including a first portion yieldably securing the lens retainer to the table, and a second portion yieldably securing the heat shield to the lens retainer.

10. The lamp assembly according to claim 3, wherein a front rim of the heat shield bears against the lens retainer; the lens retainer including downwardly projecting tabs for holding the lens in spaced relationship to the lower rim of the heat shield.

11. In the recessed lighting fixture according to claim 3, the improvement further wherein the third surface is beveled such that an end thereof intersecting the first surface is situated radially outwardly with respect to an end thereof intersecting the second surface.

12. In a recessed lighting fixture for a ceiling, comprising a frame having a first hole extending therethrough, the first hole defining a longitudinal axis; a trim ring mounted to the frame; the trim ring having a second hole extending therethrough along the longitudinal axis; the trim ring further having an annular shoulder surrounding the second hole; the annular shoulder including a first surface facing toward the first hole, and a second surface facing away from the first hole, the second surface lying in a plane; the first surface including a radially inner edge; a reflector including a wall having first and second apertures spaced apart along the longitudinal axis, the reflector including a flange extending radially outwardly with respect to the longitudinal axis; the flange engaging and resting on the first surface; the trim ring including an annular third surface extending from the radially inner edge of the fist surface in a direction toward the second surface; the third surface facing generally radially inwardly toward the longitudinal axis; the improvement wherein the reflector includes an annular bead extending from a radially inner edge of the flange in a direction toward the plane of the second surface and covering the third surface.

* * * * *